United States Patent [19]

Prevot

[11] Patent Number: 4,856,832

[45] Date of Patent: Aug. 15, 1989

[54] STRIKER PLATE FOR SLIDING WINDOWS, DOORS OR THE LIKE

[75] Inventor: Gérard Prevot, Willerwald, France

[73] Assignee: Ferco International, Sarrebourg, France

[21] Appl. No.: 124,605

[22] Filed: Nov. 24, 1987

[30] Foreign Application Priority Data

Dec. 3, 1986 [FR] France ..... 86 17020

[51] Int. Cl.[4] ..... E05C 21/02

[52] U.S. Cl. ..... 292/341.19; 292/DIG. 60

[58] Field of Search ..... 292/341.18, 341.19, 292/244, DIG. 46

[56] References Cited

U.S. PATENT DOCUMENTS

| | | | |
|---|---|---|---|
| 126,191 | 4/1872 | Dickey | 292/341.19 X |
| 1,214,227 | 1/1917 | Schwenk | 292/341.19 |
| 2,086,049 | 7/1937 | Schlaman | 292/341.19 |
| 2,153,080 | 4/1939 | Flora | 292/341.19 |
| 3,744,831 | 7/1973 | Joseph et al. | 292/244 |
| 4,024,739 | 5/1977 | Kaufman | 292/DIG. 46 X |
| 4,480,862 | 11/1984 | Fleming | 292/DIG. 46 X |

FOREIGN PATENT DOCUMENTS

| | | | |
|---|---|---|---|
| 1185948 | 1/1965 | Fed. Rep. of Germany | 292/341.19 |

*Primary Examiner*—Richard E. Moore

*Attorney, Agent, or Firm*—Sandler & Greenblum

[57] ABSTRACT

A striker plate, particularly for doors, windows, or other closures. It includes a body having a bearing face which is adapted to be secured to the interior surface of the fixed frame of the closure and a lug provided with hooking surfaces cooperating with the rear surfaces of the hooking portion of the latch bolt secured to the closure. The striker plate is provided with a bidirectional adjustment mechanism interposed between the bearing face of the body and the interior surface of the fixed frame.

14 Claims, 1 Drawing Sheet

STRIKER PLATE FOR SLIDING WINDOWS, DOORS OR THE LIKE

BACKGROUND OF THE INVENTION

1. Field of the Invention

The present invention relates to an applied striker plate for the sliding frame of windows, doors or the like, which comprises a body of which the bering face is adapted to be secured to the inner face of the fixed frame and a lug provided with hooking faces co-operating with the back faces of the hooks of the latch bolt secured to the sliding frame, and bidirectional adjustment means.

2. The Prior Art

It is known in the art that the sliding frame of a window, door of the like cannot be reliably closed and locked unless the striker plate applied to the fixed frame registers exactly with the bolt consisting essentially of a pair of opposite hooks of the latch carried by the sliding frame. However, it may happen that, as a consequence of a warping of the sliding frame and/or a dimensional error, a misalignment develops between the striker plate position and the latch bolt position. Even if this misalignment is relatively moderate, the striker plate position must be changed.

Now, though this repositioning of the striker plate is already considered as a difficult operation in the case of wooden window- or door-frames, it is practically impossible when the frames are made of section members.

SUMMARY OF THE INVENTION

It is the essential object of the present invention to avoid these inconveniences by providing a striker plate for sliding doors or windows which can be adjusted on the fixed frame without disassembling and refitting the striker plate.

For this purpose, the present invention provides a striker plate for the sliding frames of windows, doors or the like, which comprises a body of which the bearing face is adapted to be secured to the inner face of the fixed frame, a lug provided with hooking faces adapted to co-operate with the back faces of the hooks of the latch bolt secured to the sliding frame, and bidirectional adjustment means interposed between the inner face of the fixed frame and the bearing face of the body.

This invention also relates to a striker plate for the sliding frames of windows, doors or the like, which comprises a body of which the bearing face is adapted to be secured to the inner face of the fixed frame, a lug provided with hooking faces co-operating with the back faces of the hooks of the latch bolt secured to the sliding frame, and bidirectional adjustment means interposed between the inner face of the fixed frame and the bearing face of the body, said bearing face of the body comprising a cavity having embedded therein a mounting plate secured to the inner face of the fixed frame. Accordingly, the thickness of the striker plate is defined by the thickness of the body.

This invention is further concerned with a striker plate for the sliding frames of windows, doors or the like, which comprises a body of which the bearing face is adapted to be secured to the inner face of the fixed frame, a lug provided with hooking faces co-operating with the back faces of the hooks of the latch bolt secured to the sliding frame, and bidirectional adjustment means interposed between the inner face of the fixed frame and the bearing face of the body, said bearing face of the body comprising a recess having embedded therein a mounting plate secured to the inner face of the fixed frame and provided, in its face registering with the inner face of the fixed frame, a rectangular recess in which a tightening nut is embedded, this nut comprising a pair of tapped holes engageable by adjustment members extending through and through said body and said mounting plate, one of the longitudinal sides of said rectangular recess being provided with an aperture co-acting with a guide and stop member projecting from one of the longitudinal walls of the rectangular recess of said mounting plate.

The essential features characterizing the present invention lie essentially in that on the one hand the play likely to exist or develop between the applied striker plate and the bolt can be absorbed in a transverse direction, thus warranting the tightness between the vertical edge of the sliding frameand the vertical edge of the fixed frame, and on the other hand the striker plate can be positioned with precision so as to ensure a proper mutual engagement between the hooking faces of the keeper and the back faces of the bolt hooks, and a reliable locking of the sliding frame of the door, window or the like.

THE DRAWINGS

DESCRIPTION OF THE PREFERRED EMBODIMENT

Figure 1:
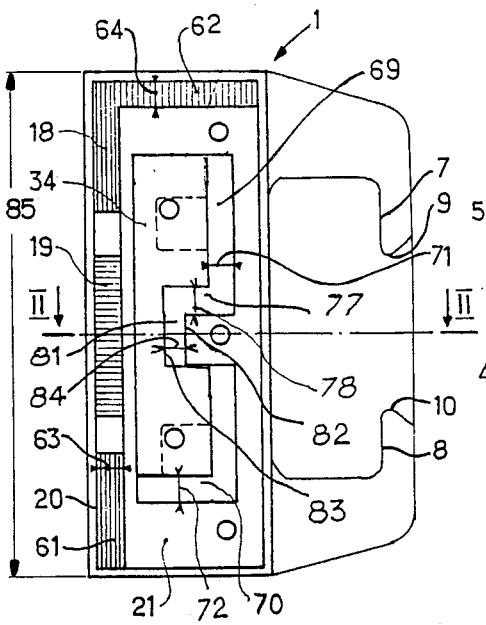
FIG. 1 is an elevational view of the striker plate according to the present invention.
Figure 3:
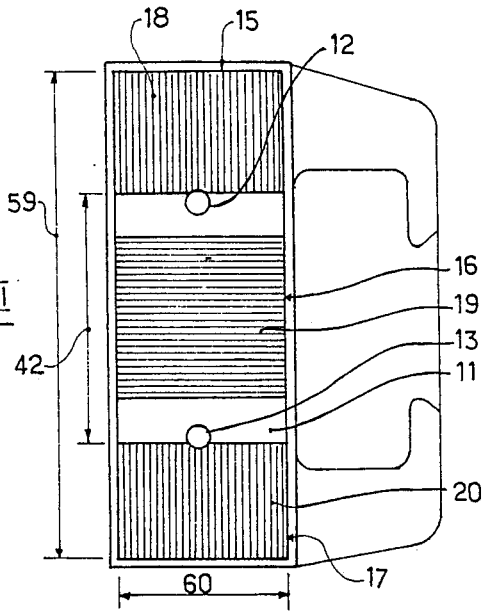
FIG. 3 is an elevational view of the bearing face of the keeper.
Figure 2:
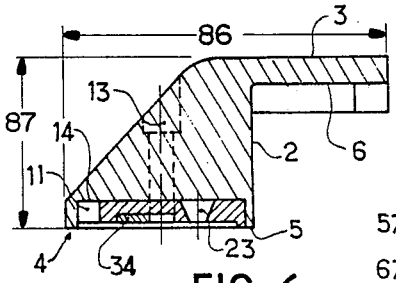
FIG. 2 is a section taken along the line II—II of FIG. 1.
Figure 4:
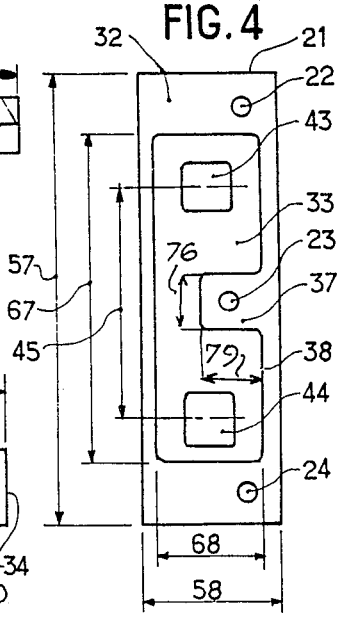
FIG. 4 is a front view of one of the major faces of the mounting plate.
Figure 5:
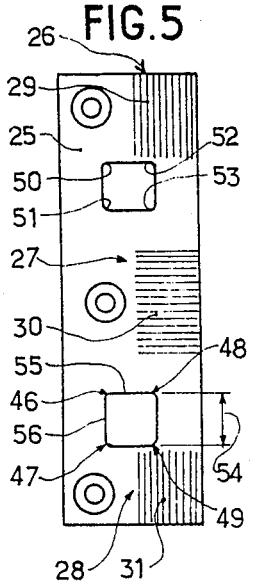
FIG. 5 is a front view of the other major face of the mounting plate.
Figure 6:
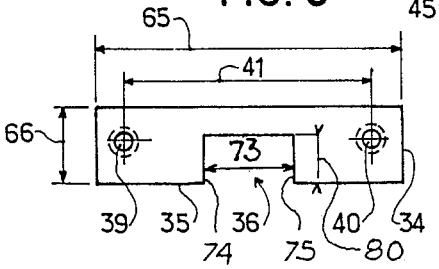
FIG. 6 is a plane view of the tightening nut.

The striker plate 1 comprises a body 2 and a lug 3 projecting laterally from the body. This body 2 is provided at one end with a bearing face 5 adapted to be secured to the inner face of a fixed frame (not shown) of a window, door or the like. The lug 3 comprises on its inner face 6 hooking surface areas 7, 8 co-operating with the back faces of the inverted hooks of a latch bolt secured to the sliding frame (not shown), said latch bolt penetrating into the keeper 1 between the two ends 9, 10 of said hooking faces.

A recess 11 is formed in the bearing face 5, and a pair of holes 12, 13 open into this recess to permit the passage of fastening members (not shown) extending through and through said body 2. In the bottom 14 of recess 11 several areas 18, 19, 20 are provided with elongated grooves.

In a first form of embodiment, said bottom 14 comprises an area 15 wherein the elongated ribs 18 extend in one direction, for example vertically, and another area 16 in which the ribs 19 extend across the ribs 18 of area 15, that is, horizontally in the example illustrated.

According to a modified form of embodiment, the bottom 14 comprises two areas 15, 17 provided with elongated ribs 18, 20 and disposed vertically on either side of an intermediate area 16 provided with elongated ribs 19 disposed horizontally.

Housed in this recess 11 is a face plate 21 of a thickness slightly inferior to the recess 11. Countersunk holes 22, 23, 24 are formed in the face plate 21 for receiving fastening members for securing the face plate 21 to the inner face of the fixed frame, the heads of said fastening members being recessed in the face plate 21.

On one face 25 of face plate 21 and more particularly on the face thereof to be applied against the bottom 14 of recess 11, several areas 26, 27, 28 provided with elongated ribs 29, 30, 31 co-acting with the elongated ribs 18, 19, 20 of areas 15, 16, 17 of the bottom 14 of said recess 11 are formed. Thus, these complementary ribs 29, 30, 31 have the same direction as the matching elongated ribs 18, 19, 20, whereby the various ribs engage each other after the necessary adjustment of the position of striker plate 1, with an interlocking action.

In the other face 32 of face plate 21 a rectangular recess 33 is also formed for fitting a tightening nut 34 therein. The depth of this rectangular recess 33 is slightly in excess of the thickness of the rectangular nut 34 so that the nut 34 be recessed in said rectangular recess 33. One of the longitudinal edges 35 of said rectangular tightening nut 34 has a notch 36 formed therein which opens into the longitudinal edge 35 and is adapted to receive a guide and stop member 37 projecting from one of the longitudinal walls 38 of said rectangular recess 33, thus preventing any untimely rotation of the tightening nut 34. A pair of tapped holes 39, 40 are formed through this nut 34 and the distance 41 between centres of the holes 12, 13 formed through the body 2.

To permit a bidirectional adjustment of the striker plate 1, the face plate 21 comprises, at the level of the fastening members securing the body 2 of striker plate 1 to the rectangular tightening nut 34, polygonal apertures 43, 44, of which the distance between centres 45 is equal to the above-defined distances between centres 41, 42. These apertures 43, 44 have a substantially square configuration and their four corners 46, 47, 48, 49 are rounded as shown at 50, 51, 52, 53 with a radius depending on the diameter of the fixing members (not shown), whereas the difference between the length 54 of the sides 55, 56 and the diameter of the fixing members (not shown) depends on the desired amplitude of vertical and/or horizontal adjustment of the position of the striker-plate. For this purpose, the height 57 and width 58 of face plate 21 are inferior to the height 59 and width 60 of recess 11, thus providing spaces 61, 62 of a width 63, 64 corresponding to the amplitude of said adjustment, respectively.

On the other hand, the height 65 and width 66 of the rectangular tightening nut 34 are smaller than the height 67 and width 68 of recess 33 of face plate 21, thus providing spaces 69, 70 having the same widths 71, 72 as the widths 63, 64 of spaces 61, 62, respectively.

Moreover, the distance 73 between the two edges 74, 75 of notch 36 is greater than the height 76 of the stop member 37 guiding the face plate 21, thus providing a space 77 having the same width 78 as the width 64 of the space 62 left between the face plate 21 and the recess 11 formed in the striker plate body 2.

In contrast thereto, the width 79 of guide and stop member 37 of face plate 21 is equal to the depth 80 of notch 36 of tightening nut 34. However, when this nut 34 is in the position shown in FIG. 1, a space 81 is left between the edge 82 of said guide and stop member 37 and the bottom 83 of notch 36 of which the distance 84 is identical with the distance 81 in space 69.

The body 2 of the striker plate 1 has a length 85, a width 86, and a thickness 87. Since face plate 21 and tightening nut 34 are positioned within recess 11, the thickness of the striker plate is defined by the thickness 87 of the body 2.

The striker plate is fitted and adjusted on the inner face of the fixed frame or jamb of the window or door by adhering to the following procedure:

The rectangular tightening bolt 34 is inserted into the rectangular recess 33 of face plate 21, care being taken that the guide and stop member 37 of this plate is properly engaged in notch 36, and that the face plate 21 is secured to the inner face of the fixed frame or jamb. The striker plate 1 is disposed on face plate 21 by inserting this face plate into the recess 11 of body 2. The fastening members are screwed through the apertures 12, 13 in the tapped holes 39, 40 of tightening nut 34. The striker plate 1 is positioned with precision, so that the various elongated ribs 18, 19, 20 of the recess 11 of body 2 and the elongated ribs 29, 30, 31 of face plate 21 fit into one another, thus locking the striker plate 1 both vertically and horizontally in the desired position.

What is claimed is:

1. A striker plate for mounting upon an interior surface of a relatively fixed frame of a relatively movable closure such as a window or door and for cooperation with a latch bolt mounted upon said closure for securing said movable closure to said fixed frame, said closure being movable in a substantially rectilinear predetermined direction, said striker plate comprising:

(a) a body having (i) a bearing face for being positioned and secured upon a predetermined surface of said fixed frame and (ii) a lug having a portion for engagement with a portion of said latch bolt for securing said latch bolt of said lug and said movable closure to said fixed frame; and (b) means for bidirectionally adjusting the position of said body and said lug upon said predetermined surface of said fixed frame within a plane of movement which is substantially parallel to said predetermined direction of movement of said movable closure, said bidirectional adjustment means being positionable between said body and said predetermined surface of said fixed frame.

2. The striker plate of claim 1 wherein said bidirectional adjustment means comprises a mounting plate to be secured in a fixed position upon said predetermined surface of said fixed frame.

3. The striker plate of claim 2 wherein said bearing face of said body comprises a recess for receiving therein said mounting plate and provided, on a face facing said predetermined surface of said fixed frame, a substantially rectangular recess having received therein a tightening nut provided with a plurality of spaced tapped holes engageable by corresponding tightening means extending through said body and said mounting plate.

4. The striker plate of claim 3 wherein said tightening nut comprises a longitudinal edge having a notch formed therein for cooperation with a guide and stop member projecting from a longitudinal wall of said substantially recess of said mounting plate.

5. The striker plate of claim 2 wherein said bearing face of said body comprises a recess having received therein said mounting plate, said mounting plate and said recess having respective lengths and widths, said striker plate further comprising spaces resulting from a difference between the respective lengths and widths of said mounting plate and said recess, said widths of said respective spaces defining a permissible adjustment amplitude of said striker plate.

6. The striker plate of claim 2 wherein said bearing face of said body comprises a recess having received therein said mounting plate, said recess having a bottom provided with at least two areas in which elongated ribs are provided, and adapted to cooperate by mutual engagement with at least two areas provided with matching elongated ribs formed on one face of said mounting plate.

7. The striker plate of claim 6 wherein one of each of said areas of said recess and said mounting plate, respectively, has elongated ribs extending at substantially right angles to said elongated ribs of the respective other area.

8. The striker plate of claim 2 wherein said bearing face of said body comprises a recess for receiving therein said mounting plate, said mounting plate comprising two areas provided with substantially vertical elongated ribs disposed on either side of an area containing substantially horizontal elongated ribs.

9. The striker plate of claim 2 wherein said bearing face of said body comprises a recess having received therein said mounting plate, said recess having a bottom having two areas provided with substantially vertical elongated ribs disposed on either side of an area provided with substantially horizontal elongated ribs.

10. The striker plate of claim 5 wherein said bearing face of said body comprises a recess having received therein said mounting plate, said mounting plate comprising a recess having received therein a tightening nut, said mounting plate recess and said tightening nut having respective lengths and widths, said striker plate comprising further spaces of a width resulting from the difference between said lengths and widths of said tightening nut and said recess of said mounting plate, respectively, which are substantially identical to said lengths and widths of said spaces resulting from said difference between the lengths and widths of said mounting plate and of said recess formed in said bearing face of said body of said striker plate, respectively.

11. The striker plate of claim 2 wherein said bearing face comprises a recess having received therein said mounting plate, said mounting plate being provided, for the reception of fastening members, with polygonal apertures of which the dimensions of the sides define a permissible amplitude of bidirectional adjustment of the position of said striker plate.

12. The striker plate of claim 2 wherein said bearing face of said body comprises a recess having received therein said mounting plate comprising a substantially rectangular recess having embedded therein a tightening nut provided with a plurality of tapped holes engagable by fastening members extending through said body and said mounting plate, a longitudinal edge of said mounting plate comprising a notch for cooperation with a guide and stop member projecting from a longitudinal wall of said rectangular recess of said mounting plate, said striker plate comprising a space of a width which results from the difference between the distance existing between two edges of said notch of said tightening nut and the length of said guide and stop member of said mounting plate, which is substantially identical with the length of a space resulting from the difference between the length of said mounting plate and the length of said recess of said bearing face of said striker plate.

13. The striker plate of claim 1 wherein said striker plate is adapted to be mounted upon said predetermined surface without providing a recess for reception of said bearing face of said body in said predetermined surface.

14. The striker plate of claim 1 further comprising a length, a width, and a thickness, wherein said body has a thickness which defines said thickness of said body.

* * * * *